US012606764B2

(12) United States Patent
Onouchi et al.

(10) Patent No.: US 12,606,764 B2
(45) Date of Patent: Apr. 21, 2026

(54) LUBRICATING OIL COMPOSITIONS

(71) Applicant: CHEVRON JAPAN LTD., Tokyo (JP)

(72) Inventors: Hisanari Onouchi, Minato-Ku (JP); Isao Tanaka, Shizuoka (JP)

(73) Assignee: Chevron Japan Ltd.

( * ) Notice: Subject to any disclaimer, the term of this patent is extended or adjusted under 35 U.S.C. 154(b) by 0 days.

(21) Appl. No.: 18/037,249

(22) PCT Filed: Nov. 16, 2021

(86) PCT No.: PCT/IB2021/060601

§ 371 (c)(1),
(2) Date: May 16, 2023

(87) PCT Pub. No.: WO2022/112899

PCT Pub. Date: Jun. 2, 2022

(65) Prior Publication Data

US 2024/0018441 A1 Jan. 18, 2024

Related U.S. Application Data

(60) Provisional application No. 63/118,163, filed on Nov. 25, 2020.

(51) Int. Cl.

| | |
|---|---|
| ***C10M 133/16*** | (2006.01) |
| ***C10M 101/00*** | (2006.01) |
| ***C10M 129/54*** | (2006.01) |
| ***C10M 137/10*** | (2006.01) |
| ***C10M 145/14*** | (2006.01) |
| ***C10M 159/24*** | (2006.01) |
| ***C10M 169/04*** | (2006.01) |
| *C10N 10/04* | (2006.01) |
| *C10N 10/10* | (2006.01) |
| *C10N 10/12* | (2006.01) |
| *C10N 20/00* | (2006.01) |
| *C10N 20/02* | (2006.01) |
| *C10N 30/04* | (2006.01) |
| *C10N 40/25* | (2006.01) |

(52) U.S. Cl.

CPC ..... *C10M 133/16* (2013.01); *C10M 101/00* (2013.01); *C10M 129/54* (2013.01); *C10M 137/10* (2013.01); *C10M 145/14* (2013.01); *C10M 159/24* (2013.01); *C10M 169/04* (2013.01); *C10M 2207/262* (2013.01); *C10M 2209/084* (2013.01); *C10M 2215/28* (2013.01); *C10M 2219/046* (2013.01); *C10M 2223/045* (2013.01); *C10N 2010/04* (2013.01); *C10N 2010/10* (2013.01); *C10N 2010/12* (2013.01); *C10N 2020/02* (2013.01); *C10N 2020/071* (2020.05); *C10N 2030/04* (2013.01); *C10N 2040/25* (2013.01)

(58) Field of Classification Search

CPC ..... C10M 133/16; C10M 101/00; C10M 129/54; C10M 137/10; C10M 145/14; C10M 159/24; C10M 169/04; C10M 2207/262; C10M 2209/084; C10M 2215/28; C10M 2219/046; C10M 2223/045; C10N 2010/04; C10N 2010/10; C10N 2010/12; C10N 2020/02; C10N 2020/071; C10N 2030/04; C10N 2040/25

See application file for complete search history.

(56) References Cited

U.S. PATENT DOCUMENTS

| | | | |
|---|---|---|---|
| 3,087,936 | A | 4/1963 | Suer |
| 3,172,892 | A | 3/1965 | Le Suer |
| 3,272,746 | A | 9/1966 | Suer |
| 3,595,791 | A | 7/1971 | Cohen |
| 3,607,749 | A | 9/1971 | Forbes |
| 3,772,196 | A | 11/1973 | St Clair |
| 4,116,917 | A | 9/1978 | Eckert |

(Continued)

FOREIGN PATENT DOCUMENTS

| | | | |
|---|---|---|---|
| CN | 102618355 | A | 9/2015 |
| CN | 110892050 | A | 6/2022 |
| EP | 0225598 | B1 | 8/1991 |
| EP | 0638611 | A1 | 2/1995 |

(Continued)

OTHER PUBLICATIONS

International Search Report, issued on Jan. 21, 2022, during the prosecution of International Application No. PCT/IB2021/060601.

(Continued)

*Primary Examiner* — Prem C Singh

*Assistant Examiner* — Francis C Campanell

(57) ABSTRACT

A lubricating oil for hybrid engine includes a major amount of an oil of lubricating viscosity; a boron-containing compound in an amount to provide 50 to 300 ppm of boron to lubricating oil composition; an overbased calcium salicylate or a mixture of an overbased calcium sulfonate and overbased calcium salicylate individually having a total base number of greater than 150 mg KOH/g, measured by the method of ASTM D-2896, present in an amount that provides 800 ppm to 1800 ppm of calcium to the lubricating oil composition; zinc dithiophosphate (ZnDTP) in an amount to bring from 100 to 800 ppm of phosphorus to the lubricating oil composition; and a non-dispersant comb polymethacrylate (PMA) viscosity index improver (VII). The boron-containing compound includes a borated dispersant. The KV at 100° C. of the lubricating oil composition is from 6 cSt to 8.5 cSt, the KV at 40° C. of the lubricating oil composition is from 25 cSt to 35 cSt, and the VI of the lubricating oil composition is greater than 200.

16 Claims, No Drawings

(56) References Cited

U.S. PATENT DOCUMENTS

| | | | |
|---|---|---|---|
| 4,259,194 | A | 3/1981 | Devries |
| 4,259,195 | A | 3/1981 | King |
| 4,261,843 | A | 4/1981 | King |
| 4,263,152 | A | 4/1981 | King |
| 4,265,773 | A | 5/1981 | Devries |
| 4,272,387 | A | 6/1981 | King |
| 4,283,295 | A | 8/1981 | Devries |
| 4,285,822 | A | 8/1981 | Devries |
| 4,320,019 | A | 3/1982 | Hayashi |
| 4,788,316 | A | 11/1988 | Thornthwaite |
| 5,391,617 | A | 2/1995 | Olivier |
| 5,650,381 | A | 7/1997 | Gatto |
| RE37,363 | E | 9/2001 | Gatto |
| 6,723,685 | B2 | 4/2004 | Hartley |
| RE38,929 | E | 1/2006 | Gatto |
| 7,402,235 | B2 | 7/2008 | Huang |
| RE40,595 | E | 12/2008 | Gatto |
| 8,076,275 | B2 | 12/2011 | Ruhe, Jr. |
| 8,778,857 | B2 | 7/2014 | Growcott |
| 2002/0038525 | A1 | 4/2002 | Callis |
| 2017/0298287 | A1 | 10/2017 | Tamura |
| 2018/0258365 | A1* | 9/2018 | Ohkubo ..... C10M 169/048 |
| 2019/0338211 | A1 | 11/2019 | Baralt |
| 2020/0248095 | A1 | 8/2020 | Guerin et al. |

FOREIGN PATENT DOCUMENTS

| | | | |
|---|---|---|---|
| EP | 2966155 | | 1/2016 |
| JP | 2017115100 | | 6/2017 |
| JP | 2019014802 | A | 1/2019 |
| WO | 2016061050 | A1 | 4/2016 |

OTHER PUBLICATIONS

Written Opinion of the International Searching Authority, issued on Jan. 21, 2022, during the prosecution of International Application No. PCT/IB2021/060601.

* cited by examiner

LUBRICATING OIL COMPOSITIONS

BACKGROUND

Modern lubricating oils are formulated to exacting specifications often set by original equipment manufacturers. To meet the exacting specifications, carefully selected lubricant additives are blended together with base oils of lubricating viscosity. A typical lubricating oil composition may contain, for example, dispersants, detergents, antioxidants, wear inhibitors, rust inhibitors, corrosion inhibitors, foam inhibitors, and/or friction modifiers. The specific application or use (e.g., hybrid vehicles) governs the set of additives that goes into a lubricating oil composition.

Hybrid vehicles rely on two distinctly different types of motive technologies—internal combustion engine and electric motor. The internal combustion engine mainly drives the vehicle at high speeds. The electric motor drives the vehicle at low speeds and can also assist the internal combustion engine when additional power is needed. It is important for hybrid vehicles to distribute power from the engine and the motor in a well-balanced manner as the vehicle speed increases.

Hybrid vehicle typically feature a start-stop system in which the engine stops when the vehicle comes to a stop and the engine fuel system suspends when the vehicle is driven only by motor or braking. Consequently, accumulation of water and fuel in the oil is a problem as the engine is not able to sufficiently evaporate the water and fuel. This results in the formation of unstable emulsions which negatively impacts engine performance and leads to corrosion in engine parts.

The differences between hybrid vehicles and conventional automobile vehicles are significant enough that conventional engine oils are not necessarily optimized for use in hybrid vehicles. Thus, lubricating oil compositions designed specifically for hybrid vehicles are needed.

SUMMARY OF THE DISCLOSURE

In an aspect, the disclosure provides a lubricating oil composition for a hybrid engine comprising: a major amount of an oil of lubricating viscosity; a boron-containing compound in an amount to provide 40 to 400 ppm of boron to the lubricating oil composition; an overbased calcium salicylate or a mixture of an overbased calcium sulfonate and overbased calcium salicylate individually having a total base number of greater than 150 mg KOH/g based on the detergent concentrate, measured by the method of ASTM D-2896, present in an amount that provides 800 ppm to 1800 ppm of calcium to the lubricating oil composition; zinc dithiophosphate (ZnDTP) in an amount to provide 100 to 800 ppm of phosphorus to the lubricating oil composition; and a non dispersant comb polymethacrylate (PMA) viscosity index improver (VII), wherein the boron-containing compound comprises a borated dispersant, the kinematic viscosity (KV) at 100° C. of the lubricating oil composition is from 6 cSt to 8.5 cSt, the KV at 40° C. of the lubricating oil composition is from 25 cSt to 35 cSt, and the viscosity index (VI) of the lubricating oil composition is greater than 200.

In another aspect, the present invention provides a method of lubricating a hybrid engine, the method comprising providing the hybrid engine with a lubricating oil comprising a major amount of an oil of lubricating viscosity; a boron-containing compound in an amount to provide 40 to 400 ppm of boron to the lubricating oil composition; an overbased calcium salicylate or a mixture of an overbased calcium sulfonate and overbased calcium salicylate individually having a total base number of greater than 150 mg KOH/g, as measured by the method of ASTM D-2896, present in an amount that provides 800 ppm to 1800 ppm of calcium to the lubricating oil composition; zinc dithiophosphate (ZnDTP) in an amount to provide 100 to 800 ppm of phosphorus to the lubricating oil composition; and a non-dispersant comb polymethacrylate (PMA) viscosity index improver (VII), wherein the boron-containing compound comprises a borated dispersant, the KV 100° C. of the lubricating oil composition is from 6 cSt to 8.5 cSt, the KV 40° C. of the lubricating oil composition is from 25 cSt to 35 cSt, and the VI of the lubricating oil composition is greater than 200.

DETAILED DESCRIPTION

While the disclosure is susceptible to various modifications and alternative forms, specific embodiments thereof are herein described in detail. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

As used herein, the following terms have the following meanings, unless expressly stated to the contrary. In this specification, the following words and expressions, if and when used, have the meanings given below.

A "major amount" means in excess of 50 weight % of a composition.

A "minor amount" means less than 50 weight % of a composition, expressed in respect of the stated additive and in respect of the total mass of all the additives present in the composition, reckoned as active ingredient of the additive or additives.

"Active ingredients" or "actives" or "oil free" refers to additive material that is not diluent or solvent.

All percentages reported are weight % on an active ingredient basis (i.e., without regard to carrier or diluent oil) unless otherwise stated.

The abbreviation "ppm" means parts per million by weight, based on the total weight of the lubricating oil composition.

High temperature high shear (HTHS) viscosity at 150° C. was determined in accordance with ASTM D4683.

Kinematic viscosity at 100° C. ($KV_{100}$) and at 40° C. (KV 40) was determined in accordance with ASTM D445.

The Viscosity Index (VI) was determined in accordance with ASTM D2270.

The term "metal" refers to alkali metals, alkaline earth metals, or mixtures thereof.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated in a lubricating oil composition. For a further discussion of the terms oil soluble and dispersible, particularly "stably dispersible", see U.S. Pat. No. 4,320,019 which is expressly incorporated herein by reference for relevant teachings in this regard.

The term "sulfated ash" as used herein refers to the non-combustible residue resulting from detergents and metallic additives in lubricating oil. Sulfated ash may be determined using ASTM Test D874.

The term "Total Base Number" or "TBN" as used herein refers to the amount of base equivalent to milligrams of KOH in one gram of sample. Thus, higher TBN numbers reflect more alkaline products, and therefore a greater alkalinity. TBN was determined using ASTM D 2896 test. TBN numbers are based on the detergent concentrate.

Boron, calcium, magnesium, molybdenum, phosphorus, sulfur, and zinc contents were determined in accordance with ASTM D5185.

Nitrogen content was determined in accordance with ASTM D4629.

All ASTM standards referred to herein are the most current versions as of the filing date of the present application.

Unless otherwise specified, all percentages are in weight percent.

The present invention provides a lubricating oil optimized for a hybrid engine. The lubricating oil comprises (a) oil of lubricating viscosity; (b) boron-containing compound comprising a borated dispersant; (c) one or more overbased calcium detergent; (d) optionally, one or more magnesium-containing detergent; (e) zinc dithiophosphate; and (f) non-dispersant comb polymethacrylate (PMA). The KV 100° C. of the lubricating oil composition is from 6 cSt to 8.5 cSt, the KV 40° C. of the lubricating oil composition is from 25 cSt to 35 cSt, and the VI of the lubricating oil composition is greater than 200.

Oil of Lubricating Viscosity

The oil of lubricating viscosity (sometimes referred to as "base stock" or "base oil") is the primary liquid constituent of a lubricant, into which additives and possibly other oils are blended, for example to produce a final lubricant (or lubricant composition). A base oil is useful for making concentrates as well as for making lubricating oil compositions therefrom, and may be selected from natural and synthetic lubricating oils and combinations thereof.

Natural oils include animal and vegetable oils, liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes); alkylbenzenes (e.g., dodecylbenzenes, tetradecylbenzenes, dinonylbenzenes, di(2-ethylhexyl)benzenes; polyphenols (e.g., biphenyls, terphenyls, alkylated polyphenols); and alkylated diphenyl ethers and alkylated diphenyl sulfides and the derivatives, analogues and homologues thereof. Polymerized olefins can also be derived from bio-derived sources such as hydrocarbon terpenes such as myrcene, ocimene and farnesene which can also be co-polymerized with other olefins and further isomerized if desired.

Another suitable class of synthetic lubricating oils comprises the esters of dicarboxylic acids (e.g., malonic acid, alkyl malonic acids, alkenyl malonic acids, succinic acid, alkyl succinic acids and alkenyl succinic acids, maleic acid, fumaric acid, azelaic acid, suberic acid, sebacic acid, adipic acid, linoleic acid dimer, phthalic acid) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, diecosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol. Also, esters from bio-derived sources are also useful as synthetic oils.

The base oil may be derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized; hydrocracked and hydroisomerized; dewaxed; or hydroisomerized and dewaxed; using processes known to those skilled in the art.

The base oil may be a renewable or bio-derived engine oil. Examples of such engine oils are disclosed in WO2016061050 and US20190338211, which is incorporated herein by reference. According to some embodiments, the renewable or bio-derived base oil includes a biobased hydrocarbon, such as an isoparaffinic hydrocarbon derived from hydrocarbon terpenes, such as myrcene, ocimene, and farnesene. In some embodiments, the biobased hydrocarbon is produced from fatty acids or fatty esters.

Unrefined, refined and re-refined oils can be used in the present lubricating oil composition. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art.

Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Hence, the base oil which may be used to make the present lubricating oil composition may be selected from any of the base oils in Groups I-V as specified in the American Petroleum Institute (API) Base Oil Interchangeability Guidelines (API Publication 1509). Such base oil groups are summarized in Table 1 below:

TABLE 1

| Group[a] | Base Oil Properties | | |
|---|---|---|---|
| | Saturates[b], wt. % | Sulfur[c], wt. % | Viscosity Index[d] |
| Group I | <90 and/or | >0.03 | 80 to <120 |
| Group II | ≥90 | ≤0.03 | 80 to <120 |
| Group III | ≥90 | ≤0.03 | ≥120 |
| Group IV | Polyalphaolefins (PAOs) | | |
| Group V | All other base stocks not included in Groups I, II, III or IV | | |

[a]Groups I-III are mineral oil base stocks.
[b]Determined in accordance with ASTM D2007.
[c]Determined in accordance with ASTM D2622, ASTM D3120, ASTM D4294 or ASTM D4927.
[d]Determined in accordance with ASTM D2270.

Base oils suitable for use herein are any of the variety corresponding to API Group II, Group III, Group IV, and Group V oils and combinations thereof, preferably the Group III to Group V oils due to their exceptional volatility, stability, viscometric and cleanliness features.

The oil of lubricating viscosity for use in the lubricating oil compositions of this disclosure, also referred to as a base oil, is typically present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered oil of lubricating viscosity used in formulating lubricating oil compositions.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C.). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt.

The lubricating oil composition can be a multi-grade oil having a viscosity grade of SAE 0W-XX, wherein XX is any one of 12, 16, and 20. According to one preferred embodiment, the lubricating oil composition has a viscosity grade of SAE 0W-20.

The lubricating oil composition has a Viscosity Index of at least 200 (e.g., 200 to 400 or 200 to 300). If the Viscosity Index of the lubricating oil composition is less than 135, it may be difficult to improve fuel efficiency while maintaining the desired HTHS viscosity at 150° C. If the Viscosity Index of the lubricating oil composition exceeds 400, evaporation properties may be reduced, and deficits due to insufficient solubility of the additives and matching properties with a seal material may be caused. According to other embodiments, the lubricating oil composition has a Viscosity Index of 200 to 290, 200 to 280, 200 to 270, 200 to 260, 200 to 250, or 200 to 240. In other embodiments, the lubricating oil composition has a Viscosity Index of 210 to 290, 210 to 280, 210 to 270, 210 to 260, 210 to 250, or 210 to 240. In other embodiments, the lubricating oil composition has a Viscosity Index of 220 to 290, 220 to 280, 220 to 270, 220 to 260, 220 to 250, or 220 to 240.

The lubricating oil composition has a Kinematic Viscosity at 100° C. in a range of 6.0 cSt to 8.0 cSt (e.g., 6.0 $mm^2/s$ to 7.9 $mm^2/s$, 6.0 $mm^2/s$ to 7.8 $mm^2/s$, 6.0 cSt to 7.7 cSt, 6.0 cSt to 7.6 cSt, 6.0 cSt to 7.5 cSt, 6.0 cSt to 7.4 cSt, 6.0 cSt to 7.3 cSt, 6.0 cSt to 7.2 cSt, 6.0 cSt to 7.1 cSt, 6.0 cSt to 7.0. cSt. In other embodiments, the lubricating oil composition has a Kinematic Viscosity at 100° C. in a range of 6.0 cSt to 8.0 cSt (e.g., 7.0 cSt to 8.0 cSt, 7.1 cSt to 8.0 cSt, 7.2 cSt to 8.0 cSt, 7.3 cSt to 8.0 cSt, 7.4 cSt to 8.0 cSt, and 7.5 cSt to 8.0 cSt. In other embodiments, the lubricating oil composition has a Kinematic Viscosity at 100° C. in a range of 6.0 cSt to 8.0 cSt (e.g., 6.1 cSt to 8.0 cSt, 6.2 cSt to 8.0 cSt, 6.3 cSt to 8.0 cSt, 6.4 cSt to 8.0 cSt, 6.5 cSt to 8.0 cSt, 6.6 cSt to 8.0 cSt, 6.7 cSt to 8.0 cSt, 6.6 cSt to 8.0 cSt, and 6.9 cSt to 8.0 cSt.

The lubricating oil composition has a Kinematic Viscosity at 40° C. in a range of 25 cSt to 35 cSt (e.g. 25 cSt to 34 cSt, 25 cSt to 33 cSt, 25 cSt to 32 cSt, 25 cSt to 31 cSt, and 25 cSt to 30 cSt. In other embodiments, the lubricating oil composition has a Kinematic Viscosity at 40° C. in a range of 25 cSt to 35 cSt (e.g. 26 cSt to 35 cSt, 27 cSt to 35 cSt, 28 cSt to 35 cSt, 29 cSt to 35 cSt, and 30 cSt to 35 cSt.

In general, the level of sulfur in the lubricating oil composition is less than or equal to about 0.7 wt. %, based on the total weight of the lubricating oil composition. For example, the lubricating oil composition can have a level of sulfur of about 0.01 wt. % to 0.5 wt. %, 0.01 wt. % to 0.4 wt. %, 0.01 wt. % to 0.3 wt. %, 0.01 wt. % to 0.2 wt. %, or 0.01 wt. % to 0.10 wt. %. In one embodiment, the level of sulfur in the lubricating oil composition is less than or equal to about 0.60 wt. %, less than or equal to about 0.50 wt. %, less than or equal to about 0.40 wt. %, less than or equal to about 0.30 wt. %, less than or equal to about 0.20 wt. %, or less than or equal to about 0.10 wt. %, based on the total weight of the lubricating oil composition.

In one embodiment, the level of phosphorus in the lubricating oil composition is less than or equal to about 0.08 wt. %, based on the total weight of the lubricating oil composition, e.g., a level of phosphorus of about 0.01 wt. % to about 0.08 wt. %. In one embodiment, the level of phosphorus in the lubricating oil composition is less than or equal to about 0.07 wt. %, based on the total weight of the lubricating oil composition, e.g., a level of phosphorus of about 0.01 wt. % to about 0.07 wt. %. In one embodiment, the level of phosphorus in the lubricating oil composition is less than or equal to about 0.05 wt. %, based on the total weight of the lubricating oil composition, e.g., a level of phosphorus of about 0.01 wt. % to about 0.05 wt. %.

In one embodiment, the level of sulfated ash produced by the lubricating oil composition is less than or equal to about 1.00 wt. % as determined by ASTM D874, e.g., a level of sulfated ash of from about 0.10 wt. % to about 1.00 wt. % as determined by ASTM D874. In one embodiment, the level of sulfated ash produced by the lubricating oil composition is less than or equal to about 0.80 wt. % as determined by ASTM D874, e.g., a level of sulfated ash of from about 0.10 wt. % to about 0.80 wt. % as determined by ASTM D874. In one embodiment, the level of sulfated ash produced by the lubricating oil composition is less than or equal to about 0.60 wt. % as determined by ASTM D874, e.g., a level of sulfated ash of from about 0.10 wt. % to about 0.60 wt. % as determined by ASTM D874.

Suitably, the present lubricating oil composition may have a total base number (TBN) of 4 to 15 mg KOH/g (e.g., 5 mg KOH/g to 12 mg KOH/g, 6 mg KOH/g to 12 mg KOH/g, or 8 mg KOH/g to 12 mg KOH/g).

The present lubricating oil compositions may also contain conventional lubricant additives for imparting auxiliary functions to give a finished lubricating oil composition in which these additives are dispersed or dissolved. For example, the lubricating oil compositions can be blended with antioxidants, ashless dispersants, anti-wear agents, detergents such as metal detergents, rust inhibitors, demulsifying agents, friction modifiers, metal deactivating agents, pour point depressants, viscosity modifiers, antifoaming agents, co-solvents, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Each of the foregoing additives, when used, is used at a functionally effective amount to impart the desired properties to the lubricant. Thus, for example, if an additive is an ashless dispersant, a functionally effective amount of this ashless dispersant would be an amount sufficient to impart the desired dispersancy characteristics to the lubricant. Generally, the concentration of each of these additives, when used, may range, unless otherwise specified, from about 0.001 to about 20 wt. %, such as about 0.01 to about 10 wt. %.

Boron-Containing Compound

The lubricating oil composition of the present invention comprises a borated dispersant in an amount to provide 40 to 400 ppm boron, for example, 50 to 290 ppm, 50 to 280 ppm, 50 to 270 ppm, 50 to 260 ppm, 50 to 250 ppm, 50 to 240 ppm, 50 to 230 ppm, 50 to 200 ppm, 50 to 190 ppm, 50 to 180 ppm, 50 to 170 ppm, 50 to 160 ppm, 50 to 150 ppm by weight, based on the weight of the lubricating oil composition.

Examples of borated dispersants include borated ashless dispersants such as borated polyalkenyl succinic anhydrides; borated non-nitrogen containing derivatives of a polyalkylene succinic anhydride; borated basic nitrogen compounds selected from the group consisting of succinimides, carboxylic acid amides, hydrocarbyl monoamines, hydrocarbyl polyamines, Mannich bases, phosphonoamides, thiophosphonamides and phosphoramides, thiazoles (e.g., 2,5-di mercapto-1,3,4-thiadiazoles, mercaptobenzothiazoles and derivatives thereof), triazoles (e.g., alkyltriazoles and benzotriazoles), copolymers which contain a carboxylate ester with one or more additional polar function, including amine, amide, imine, imide, hydroxyl, carboxyl, and the like (e.g., products prepared by copolymerization of long chain alkyl acrylates or methacrylates with monomers of the above function); and the like and combinations thereof. A preferred borated dispersant is a succinimide derivative of boron such as, for example, a borated polyisobutenyl succinimide.

Examples of borated ashless dispersants are borated ashless hydrocarbyl succinimide dispersants prepared by reacting a hydrocarbyl succinic acid or anhydride with an amine. Preferred hydrocarbyl succinic acids or anhydrides are those where the hydrocarbyl group is derived from a polymer of a $C_3$ or $C_4$ monoolefin, especially a polyisobutylene wherein the polyisobutenyl group has a number average molecular weight (Mn) of from 700 to 5,000, more preferably from 900 to 2,500. Such dispersants generally have at least 1, preferably 1 to 2, more preferably 1.1 to 1.8, succinic groups for each polyisobutenyl group. In one embodiment, the oil soluble or oil dispersible borated polyisobutylene succinimide dispersant, is derived from a polyisobutylene group having a number average molecular weight of from about 550 to about 5000. In one embodiment, the oil soluble or oil dispersible borated polyisobutylene succinimide dispersant, is derived from a polyisobutylene group having a number average molecular weight of from about 550 to about 4000. In one embodiment, the oil soluble or oil dispersible borated polyisobutylene succinimide dispersant, is derived from a polyisobutylene group having a number average molecular weight of from about 550 to about 3000. In one embodiment, the oil soluble or oil dispersible borated polyisobutylene succinimide dispersant is derived from a polyisobutylene group having a number average molecular weight of greater than 550 to about 2300. In one embodiment, the oil soluble or oil dispersible borated polyisobutylene succinimide dispersant, is derived from a polyisobutylene group having a number average molecular weight of from about 950 to about 2300. In one embodiment, the oil soluble or oil dispersible borated polyisobutylene succinimide dispersant, is derived from a polyisobutylene group having a number average molecular weight of from about 950 to about 1700. In one embodiment, the oil soluble or oil dispersible borated polyisobutylene succinimide dispersant is derived from a polyisobutylene group having a number average molecular weight of about 2300. In one embodiment, the oil soluble or oil dispersible borated polyisobutylene succinimide dispersant is derived from a polyisobutylene group having a number average molecular weight of about 1700. In one embodiment, the oil soluble or oil dispersible borated polyisobutylene succinimide dispersant, is derived from a polyisobutylene group having a number average molecular weight of about 1000.

Preferred amines for reaction to form the succinimide are polyamines having from 2 to 60 carbon atoms and from 2 to 12 nitrogen atoms per molecule. Particularly preferred amines include polyalkyleneamines represented by the formula:

$$NH_2(CH_2)_n—(NH(CH_2)_n)_m—NH_2$$

wherein n is 2 to 3 and m is 0 to 10. Illustrative examples include ethylene diamine, diethylene triamine, triethylene tetramine, tetraethylene pentamine, tetrapropylene pentamine, pentaethylene hexamine and the like, as well as the commercially available mixtures of such polyamines. Amines including other groups such as hydroxy, alkoxy, amide, nitride and imidazoline groups may also be used, as may polyoxyalkylene polyamines. The amines are reacted with the alkenyl succinic acid or anhydride in conventional ratios of about 1:1 to 10:1, preferably 1:1 to 3:1, moles of alkenyl succinic acid or anhydride to polyamine, and preferably in a ratio of about 1:1, typically by heating the reactants to from 100° to 250° C., preferably 125° to 175° C. for 1 to 10, preferably 2 to 6, hours.

The boration of alkenyl succinimide dispersants is also well known in the art as disclosed in U.S. Pat. Nos. 3,087,936 and 3,254,025. The succinimide may for example be treated with a boron compound selected from the group consisting of boron, boron oxides, boron halides, boron acids and esters thereof, in an amount to provide from 0.1 atomic proportion of boron to 10 atomic proportions of boron for each atomic proportion of nitrogen in the dispersant.

The borated product will generally contain 0.1 to 2.0, preferably 0.2 to 0.8 weight percent boron based upon the total weight of the borated dispersant. Boron is considered to be present as dehydrated boric acid polymers attaching at the meta borate salt of the imide. The boration reaction is readily carried out adding from 1 to 3 weight percent (based on the weight of dispersant) of said boron compound.

Detergent

The lubricating oil of the present invention comprises one or more detergents. The one or more detergents may be an overbased calcium salicylate or a mixture of overbased calcium sulfonate and overbased calcium salicylate. The detergents individually have a TBN of greater than 150 mg KOH/g (as measured by ASTM D-2896). The detergent(s) are present in an amount that provides about 800 ppm to about 1800 ppm (e.g., 800 to 1700, 900 to 1600, 1000 to 1500, 1100 to 1400, 1200 to 1300) of calcium to the lubricating oil composition. Optionally, the one or more detergents may include a magnesium-containing detergent in an amount to provide 100 to 600 ppm of magnesium to the lubricating oil composition. The detergents may be prepared by any compatible method. In one embodiment, the magnesium detergent is an overbased magnesium sulfonate detergent.

Sulfonates may be prepared from sulfonic acids which are typically obtained by the sulfonation of alkyl-substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives. The alkylation may be carried out in the presence of a catalyst with alkylating agents having from about 3 to more than 70 carbon atoms. The alkaryl sulfonates usually contain from about 9 to 80 or more carbon atoms (e.g., about 16 to 60 carbon atoms) per alkyl substituted aromatic moiety.

Salicylates may be prepared by reacting a basic metal compound with at least one carboxylic acid and removing water from the reaction product. Detergents made from salicylic acid are one class of detergents prepared from carboxylic acids. Useful salicylates include long chain alkyl salicylates. One useful family of compositions is of the following structure:

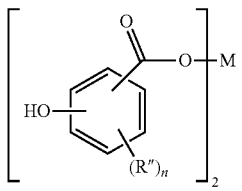

wherein R" is a $C_1$ to $C_{30}$ (e.g., $C_{13}$ to $C_{30}$) alkyl group; n is an integer from 1 to 4; and M is an alkaline earth metal (e.g., Ca or Mg).

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

The terminology "overbased" relates to metal salts, such as metal salts of sulfonates, salicylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, salicylic acids, or phenols.

An overbased detergent has a TBN of greater 150 mg KOH/gram or greater, a TBN of about 250 mg KOH/gram or greater, or a TBN of about 300 mg KOH/gram or greater, or a TBN of about 350 mg KOH/gram or greater, or a TBN of about 375 mg KOH/gram or greater, or a TBN of about 400 mg KOH/gram or greater based on the detergent concentrate.

The overbased detergent may have a metal to substrate ratio of from 1.1:1, or from 2:1, or from 4:1, or from 5:1, or from 7:1, or from 10:1.

Overbased Sulfonate and/or Salicylate

The lubricating oil composition comprises an overbased calcium salicylate or a mixture of an overbased calcium sulfonate and overbased calcium salicylate individually having a total base number of greater than 150 mg KOH/g, measured by the method of ASTM D-2896 present in an amount that provides 800 ppm to 1700 ppm of calcium to the lubricating oil composition. In other embodiments, the overbased calcium salicylate or a mixture of an overbased calcium sulfonate and overbased calcium salicylate individually having a total base number of greater than 150 mg KOH/g, measured by the method of ASTM D-2896 present in an amount that provides 800 ppm to 1800 ppm of calcium, for example, 800 to 1250 ppm of calcium, 850 to 1250 ppm of calcium, to the lubricating oil composition. In other embodiments, the overbased calcium salicylate or a mixture of an overbased calcium sulfonate and overbased calcium salicylate individually having a total base number of greater than 150 mg KOH/g, measured by the method of ASTM D-2896 present in an amount that provides 800 ppm to 1800 ppm of calcium, 900 to 1700 ppm of calcium, 950 to 1700 ppm of calcium, to the lubricating oil composition.

Magnesium-Containing Detergent

The one or more magnesium-containing detergents may be overbased magnesium-containing detergents having a total base number of greater than 150 mg KOH/g, measured by the method of ASTM D-2896. The one or more overbased magnesium-containing detergents may be an overbased magnesium sulfonate detergent, an overbased magnesium phenate detergent, an overbased magnesium salicylate detergent or mixtures thereof. In certain embodiments, the magnesium detergent may have a TBN of about 250 mg KOH/gram or greater, or a TBN of about 300 mg KOH/gram or greater, or a TBN of about 350 mg KOH/gram or greater, or a TBN of about 375 mg KOH/gram or greater, or a TBN of about 400 mg KOH/gram or greater based on the detergent concentrate.

Preferred magnesium-containing detergents include magnesium sulfonates, magnesium phenates, and magnesium salicylates, especially magnesium sulfonates.

The magnesium-containing detergent may be used in an amount that provides at least 100 ppm (e.g., 100 to 600 ppm, 100 to 500 ppm, 100 to 400 ppm, 150 to 600 ppm, 150 to 550 ppm, 150 to 500 ppm, 200 to 600 ppm, 200 to 550 ppm, 200 to 500 ppm, 250 to 600 ppm, 250 to 550 ppm, 250 to 500 ppm) by weight of magnesium to the lubricating oil composition.

Zinc Dithiophosphate (ZnDTP)

Antiwear agents reduce wear of metal parts. Suitable anti-wear agents include dihydrocarbyl dithiophosphate metal salts such as zinc dihydrocarbyl dithiophosphates (ZnDTP) of formula:

$$Zn[S—P(=S)(OR^1)(OR^2)]_2$$

wherein $R^1$ and $R^2$ may be the same of different hydrocarbyl radicals having from 1 to 18 (e.g., 2 to 12) carbon atoms and including radicals such as alkyl, alkenyl, aryl, arylalkyl, alkaryl and cycloaliphatic radicals. Particularly preferred as $R^1$ and $R^2$ groups are alkyl groups having from 2 to 8 carbon atoms (e.g., the alkyl radicals may be ethyl, n-propyl, isopropyl, n-butyl, isobutyl, sec-butyl, n-pentyl, isopentyl, n-hexyl, isohexyl, 2-ethylhexyl). In order to obtain oil solubility, the total number of carbon atoms (i.e., $R^1+R^2$) will be at least 5. The zinc dihydrocarbyl dithiophosphate can therefore comprise zinc dialkyl dithiophosphates. The zinc dialkyl dithiophosphate can be a primary or secondary zinc dialkyl dithiophosphate or mixtures thereof. ZnDTP is present in an amount to provide 100 to 800 ppm of phosphorus to the lubricating oil composition.

Molybdenum-Containing Compound

The lubricating oil composition of the present invention may comprise a molybdenum-containing compound in an amount to provide about 50 to about 1000, for example, about 50 to about 900 ppm, about 50 to about 800 ppm, about 50 to about 750 ppm, about 50 to about 500 ppm, about 50 to about 450 ppm, about 50 to about 400 ppm, about 50 to about 350, or about 50 to about 300 ppm of molybdenum to the lubricating oil composition.

An oil-soluble molybdenum-containing compound may have the functional performance of an antiwear agent, an antioxidant, a friction modifier, or mixtures thereof. An oil-soluble molybdenum-containing compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organomolybdenum compound, molybdenum esters, molybdenum amides, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof.

In one embodiment the oil-soluble molybdenum compound may be a molybdenum dithiocarbamate.

Molybdenum dithiocarbamate (MoDTC) is an organomolybdenum compound represented by the following structure:

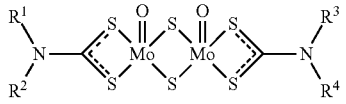

wherein $R^1$, $R^2$, $R^3$ and $R^4$ are independently of each other, linear or branched alkyl groups having from 4 to 18 carbon atoms (e.g., 8 to 13 carbon atoms).

Molybdenum dithiophosphate (MoDTP) is an organomolybdenum compound represented by the following structure:

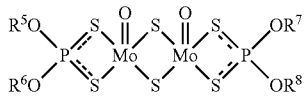

wherein $R^5$, $R^6$, $R^7$ and $R^8$ are independently of each other, linear or branched alkyl groups having from 4 to 18 carbon atoms (e.g., 8 to 13 carbon atoms).

Suitable examples of molybdenum-containing compounds which may be used include commercial materials sold under the trade names such as Molyvan 822™, Molyvan™ A, Molyvan 2000™ and Molyvan 855™ from R. T. Vanderbilt Co., Ltd., and Sakura-Lube™ S-165, S-200, S-300, S-310G, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1, incorporated herein by reference in their entireties.

Additionally, the molybdenum-containing compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and US Patent Publication No. 2002/0038525, incorporated herein by reference in their entireties.

Another class of suitable molybdenum-containing compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum-containing compounds are described in U.S. Pat. No. 6,723,685, herein incorporated by reference in its entirety.

In one embodiment, the molybdenum amine is a molybdenum-succinimide complex. Suitable molybdenum-succinimide complexes are described, for example, in U.S. Pat. No. 8,076,275. These complexes are prepared by a process comprising reacting an acidic molybdenum compound with an alkyl or alkenyl succinimide of a polyamine of structures below or mixtures thereof:

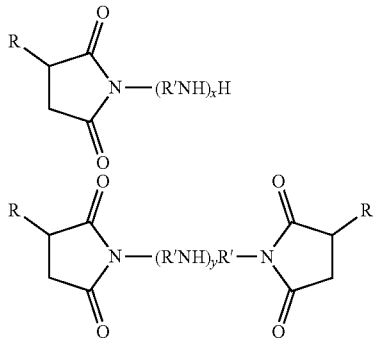

wherein R is a $C_{24}$ to $C_{350}$ (e.g., $C_{70}$ to $C_{128}$) alkyl or alkenyl group; R' is a straight or branched-chain alkylene group having 2 to 3 carbon atoms; x is 1 to 11; and y is 1 to 10.

The molybdenum-containing compounds used to prepare the molybdenum-succinimide complex are acidic molybdenum compounds or salts of acidic molybdenum compounds. By "acidic" is meant that the molybdenum compounds will react with a basic nitrogen compound as measured by ASTM D664 or D2896. Generally, the acidic molybdenum compounds are hexavalent. Representative examples of suitable molybdenum compounds include molybdenum trioxide, molybdic acid, ammonium molybdate, sodium molybdate, potassium molybdate and other alkaline metal molybdates and other molybdenum salts such as hydrogen salts, (e.g., hydrogen sodium molybdate), $MoOCl_4$, $MoO_2Br_2$, $Mo_2O_3Cl_6$, and the like.

The succinimides that can be used to prepare the molybdenum-succinimide complex are disclosed in numerous references and are well known in the art. Certain fundamental types of succinimides and the related materials encompassed by the term of art "succinimide" are taught in U.S. Pat. Nos. 3,172,892; 3,219,666; and 3,272,746. The term "succinimide" is understood in the art to include many of the amide, imide, and amidine species which may also be formed. The predominant product however is a succinimide and this term has been generally accepted as meaning the product of a reaction of an alkyl or alkenyl substituted succinic acid or anhydride with a nitrogen-containing compound. Preferred succinimides are those prepared by reacting a polyisobutenyl succinic anhydride of about 70 to 128 carbon atoms with a polyalkylene polyamine selected from triethylenetetramine, tetraethylenepentamine, and mixtures thereof.

The molybdenum-succinimide complex may be post-treated with a sulfur source at a suitable pressure and a temperature not to exceed 120° C. to provide a sulfurized molybdenum-succinimide complex. The sulfurization step may be carried out for a period of from about 0.5 to 5 hours (e.g., 0.5 to 2 hours). Suitable sources of sulfur include elemental sulfur, hydrogen sulfide, phosphorus pentasulfide, organic polysulfides of formula $R_2S_x$ where R is hydrocarbyl (e.g., $C_1$ to $C_{10}$ alkyl) and x is at least 3, $C_1$ to $C_{10}$ mercaptans, inorganic sulfides and polysulfides, thioacetamide, and thiourea.

Viscosity Modifier

Viscosity modifiers (VM), sometimes referred to as viscosity index improvers (VIIs), are present in the lubricating oil composition to impart high and low temperature operability. The viscosity modifiers increase the viscosity of the lubricating oil composition at elevated temperatures, which increases film thickness, while having limited effect on viscosity at low temperatures.

Viscosity modifiers may be used to impart that sole function or may be multifunctional. Multifunctional viscosity modifiers can also function as a dispersant.

Examples of suitable viscosity modifiers are polymers and copolymers of methacrylate, butadiene, olefins, or alkylated styrenes. Other suitable viscosity modifiers include copolymers of ethylene and propylene, hydrogenated block copolymers of styrene and isoprene, and polyacrylates (copolymers of various chain length acrylates, for example).

The viscosity modifiers can be present in the lubricating oil composition in a total amount of 0.001 wt. % to 10 wt. %, based on the total weight of the lubricating oil composition. In other embodiments, the viscosity modifiers can be present in a total amount of 0.01 wt. % to 8 wt. %, 0.1 wt. % to 5 wt. %, 0.4 wt. % to 4 wt. %, 0.6 wt. % to 3 wt. %, 0.7 wt. % to 2 wt. %, 1 wt. % to 1.5 wt. %, or 1.05 wt. % to 1.44 wt. %, based on the total weight of the lubricating oil composition. In some example embodiments, the viscosity modifiers are present in a total amount of 1.0 wt. % to 1.2 wt. %, 1.3 wt. % to 1.4 wt. %, or 1.4 wt. % to 1.5 wt. %, based on the total weight of the lubricating oil composition.

Particularly useful viscosity modifier is non-dispersant comb polymethacrylate (comb PMA).

Non-Dispersant Comb Polymethacrylate

The non-dispersant comb polymethacrylate (comb PMA) is a comb-shaped polymer that can be used as a viscosity modifier or viscosity index improver.

In one embodiment, the non-dispersant comb PMA has a weight average molecular weight (Mw) of 300,000 g/mol to 600,000 g/mol, 350,000 g/mol to 550,000 g/mol, 375,000 g/mol to 500,000 g/mol, or 390,000 g/mol to 460,000 g/mol.

In one embodiment, the non-dispersant comb PMA has a number average molecular weight (Mn) of 35,000 g/mol to 105,000 g/mol, 45,000 g/mol to 95,000 g/mol, 55,000 g/mol to 85,000 g/mol, or 65,000 g/mol to 75,000 g/mol. In another embodiment, the non-dispersant comb PMA has a number average molecular weight (Mn) of 150,000 g/mol to 250,000 g/mol or 200,000 g/mol to 215,000 g/mol.

In one embodiment, the non-dispersant comb PMA has a Shear Stability index (SSI) of 0.1 to 1.0, 0.2 to 0.9, or 0.3 to 0.8.

The non-dispersant comb PMA of the lubricating oil composition can be described as set forth in US 2017/0298287A1 and JP2019014802, the disclosures of which is incorporated herein by reference. The non-dispersant comb PMA can be provided by Viscoplex® Viscosity Index Improver 3-201 and/or 3-162, which are available from Evonik.

According to one embodiment, the non-dispersant comb PMA is provided by the compound referred to as Viscoplex® 3-201, which includes, as a main resin component, a comb PMA. This non-dispersant comb PMA has a weight average molecular weight (Mw) of 420,000 g/mol, a number average molecular weight (Mn) of 70,946 g/mol, and a Mw/Mn of 5.92. The compound has at least a constituent unit derived from a macromonomer having a Mn of 500 or more. The non-dispersant comb PMA is present in an amount of 19 wt. %, based on the total weight of the compound.

According to another embodiment, the non-dispersant comb PMA is provided by the compound referred to as Viscoplex® 3-162, which also includes, as a main resin component, a comb PMA. This non-dispersant comb PMA has a weight average molecular weight (Mw) of 399,292 g/mol, a number average molecular weight (Mn) of 205,952 g/mol, a Mw/Mn of 1.94, and a Shear Stability Index (SSI) of 0.6.

According to another embodiment, the non-dispersant comb PMA is provided by a combination of compounds, for example a combination of the Viscoplex® 3-201 and the Viscoplex® 3-162.

The non-dispersant comb PMA is typically present in an amount of 0.5 wt. % to 25 wt. %, 1 wt. % to 20 wt. %, 2 wt. % to 18 wt, %, 4 wt. % to 16 wt, %, or 5 wt. % to 15 wt. %, based on the total weight of the lubricating oil composition.

Other Viscosity Modifiers

Linear poly(meth)acrylates (PMA) are generally synthesized by simple free-radical copolymerization of a mixture of different alkyl methacrylates. Unlike comb-type PMAs, conventional linear PMAs are characterized by predominantly short alkyl chain lengths present (typically 1-50 carbons) and the lack of long alkyl chain macromonomers which give comb polymers their characteristic shape. PMAs make it possible to obtain low-temperature rheological properties which are superior to those of the OCPs. On the other hand, the thickening efficiency of PMAs is generally inferior to that of the OCPs and therefore must be used in higher concentrations to achieve the same effect. See U.S. Pat. Nos. 3,607.749 and 8,778,857, and European Patent 0225,598.

Olefin copolymers (OCP) viscosity modifiers with high thickening efficiency are advantageous in multi-grade finished lubricants to provide a lower formulation costs and a reduced risk of deposit formation. This benefit comes from lower usage of the polymer in the fully formulated oil. Traditionally and known in the art, the thickening efficiency of an OCP is increased by maximizing the ethylene content, but this puts the polymer at risk of causing low temperature performance shortcomings in a finished lubricant. Low temperature shortcomings may be mitigated use of blends of amorphous and semi-crystalline ethylene-based copolymers for lubricant oil formulations has allowed for increased thickening efficiency, shear stability index, low temperature viscosity performance and pour point. See, e.g., U.S. Pat. Nos. 7,402,235 and 5,391,617, and European Patent 0638,611.

Hydrogenated styrene-diene (HSD) type viscosity index improvers can be prepared by copolymerizing styrene and butadiene and hydrogenating the unsaturated copolymers. The hydrogenated styrene-diene copolymers can be linear block copolymers or star-shaped. Star-shaped HSD copolymers exhibit superior shear stability compared to linear counterparts due to their radial architecture, which resists degradation of the polymer even under severe engine operating conditions and reduces permanent viscosity decrease of the lubricating oil. See U.S. Pat. Nos. 4,116,917, 3,772,196 and 4,788,316 for examples of HSD copolymers as viscosity modifiers in lubricating oils.

EXAMPLES

The following examples are intended for illustrative purposes only and do not limit in any way the scope of the present disclosure.

Each inventive and comparative example was formulated with a mixture of borated and ethylene carbonate-post treated succinimide dispersant, overbased calcium sulfonate detergent, amine antioxidant, borated ester friction modifier, molybdenum succinimide complex, a mixture of primary and secondary ZnDTP, as well as minor amounts of foam inhibitor, polymethacrylate-based pour point depressant. Additionally, some examples also contained overbased calcium salicylate detergent and/or neutral calcium sulfonate detergent.

Table 1 summarizes the metal content and the source of metal present in Examples 1 to 7 and Comparative Examples 1 to 7. Each sample also includes either a non-dispersant comb PMA viscosity modifier, an olefin copolymer viscosity modifier, a linear PMA viscosity modifier, or a styrene-isoprene copolymer viscosity modifier. The remainder of the lubricating composition is made up of Group Ill base oil. Table 1 also includes viscoelastic properties of the samples.

TABLE 1

| | Ex. 1 | Ex. 2 | Ex. 3 | Ex. 4 | Ex. 5 | Ex. 6 | Ex. 7 |
|---|---|---|---|---|---|---|---|
| Boron content (borated dispersant) | 190 ppm | 190 ppm | 40 ppm | 40 ppm | 90 ppm | 220 ppm | 380 ppm |
| Calcium content (overbased sulfonate) | 800 ppm | 360 ppm | 800 ppm | 360 ppm | 340 ppm | 800 ppm | 340 ppm |
| Calcium content (overbased salicylate) | 880 ppm | 820 ppm | 880 ppm | 820 ppm | 920 ppm | 1000 ppm | 0 ppm |
| Calcium content (LOB sulfonate) | 60 ppm | 60 ppm | 60 ppm | 60 ppm | 0 ppm | 0 ppm | 0 ppm |
| Phosphorus content | 660 ppm | 660 ppm | 660 ppm | 660 ppm | 660 ppm | 660 ppm | 660 ppm |
| Molybdenum content | 270 ppm | 270 ppm | 270 ppm | 270 ppm | 140 ppm | 140 ppm | 140 ppm |
| Non-dispersant comb PMA | 9.5 wt % | 9.5 wt % | 9.5 wt % | 9.5 wt % | 9.5 wt % | 9.5 wt % | 9.5 wt % |
| Viscosity Grade | 0W-20 | 0W-20 | 0W-20 | 0W-20 | 0W-20 | 0W-20 | 0W-20 |
| Viscosity Index | 240 | 243 | 240 | 243 | 243 | 237 | 235 |
| KV100 | 7.5 cSt | 7.5 cSt | 7.4 cSt | 7.4 cSt | 7.5 cSt | 7.3 cSt | 8.1 cSt |
| KV40 | 29.3 cSt | 29.0 cSt | 29.1 cSt | 28.8 cSt | 29.3 cSt | 28.8 cSt | 32.8 cSt |

| | Comp 1 | Comp 2 | Comp 3 | Comp 4 | Comp 5 | Comp 6 |
|---|---|---|---|---|---|---|
| Boron content | 40 ppm | 190 ppm | 40 ppm | 190 pm | 190 ppm | 0 ppm |
| Calcium content (overbased sulfonate) | 860 ppm | 860 ppm | 860 ppm | 360 ppm | 360 ppm | 800 ppm |
| Calcium content (overbased salicylate) | 60 ppm | 60 ppm | 60 ppm | 60 ppm | 60 ppm | 60 ppm |
| Calcium content (LOB sulfonate) | 310 ppm | 310 ppm | 310 ppm | 820 ppm | 0 ppm | 0 ppm |
| Phosphorus content | 660 ppm | 660 ppm | 660 ppm | 660 ppm | 660 ppm | 660 ppm |
| Molybdenum content | 270 ppm | 270 ppm | 270 ppm | 270 ppm | 270 ppm | 270 ppm |
| Non-dispersant comb PMA | | 9.5 wt % | 9.5 wt % | 9.5 wt % | | |
| Olefin Copolymer | 7.2 wt % | | | | | |
| Non-dispersant linear PMA | | | | | 6.0 wt % | 6.0 wt % |
| Viscosity Grade | 0W-20 | 0W-20 | 0W-20 | 0W-20 | 0W-30 | 0W-20 |
| Viscosity Index | 170 | 240 | 240 | 240 | 218 | 220 |
| KV100 | 8.1 cSt | 7.4 cSt | 7.3 cSt | 7.4 cSt | 9.6 cSt | 9.5 cSt |
| KV40 | 42.0 cSt | 28.8 cSt | 28.8 cSt | 29.0 cSt | 42.7 cSt | 41.9 cSt |

TABLE 1-continued

| | Comp 7 |
|---|---|
| Boron content | 90 ppm |
| Calcium content (overbased sulfonate) | 340 ppm |
| Calcium content (overbased salicylate) | 0 ppm |
| Calcium content (LOB sulfonate) | 0 ppm |
| Phosphorus content | 660 ppm |
| Molybdenum content | 140 ppm |
| Foam inhibitor | |
| Styrene-isoprene copolymer | 6.6 wt % |
| Viscosity Grade | 0W-20 |
| Viscosity Index | 174 |
| KV100 | 9.0 cSt |
| KV40 | 47.1 cSt |

The boron is from a borated succinimide dispersant. Calcium may be sourced from at least 3 different detergent sources: overbased calcium sulfonate having TBN of 425 mg KOH/g and a Ca content of 16.1 wt. % based on the concentrate; overbased salicylate detergent having a TBN of 175 mg KOH/g and a Ca content of 6.25 wt. % based on the concentrate; low overbased calcium sulfonate detergent having a TBN of 17 mg KOH/g and a Ca content of 2.3 wt. % based on the concentrate.

The samples also contain phosphorus sourced from approximately a 2:1 mixture of primary to secondary zinc dialkyldithiophosphate. Molybdenum is from a molybdenum succinimide antioxidant.

Mini-Rotary Viscometer Test (MRV)

In this modified MRV test, a test oil is first mixed with 10 wt % water at a speed of 10,000 rpm for 1 minute, and then cooled to test temperature, in this case −35° C. for 24 hours in a mini-rotary viscometer cell. Each cell contains a calibrated rotor-stator set, in which the rotor is rotated by means of a string wound around the rotor shaft and attached to a weight. A series of increasing weights are applied to the string starting with a 10 g weight until rotation occurs to determine the yield stress. Results are reported as Yield Stress as the applied force in Pascals. A 150 g weight is then applied to determine the apparent viscosity of the oil. The larger the apparent viscosity, the more likely it is that the oil will not be continuously and adequately supplied to the oil pump inlet. Results are reported as Viscosity in centipoise.

The results of the MRV test for each of the lubricating oil compositions are set forth below in Table 2. Examples passed the MRV test while the Comparative Examples failed the MRV test.

TABLE 2

| Example | Yield Stress (−35° C.) Pa | Viscosity (−35° C.) cP (<60,000) |
|---|---|---|
| Ex. 1 | Y ≤ 35 | 10320 |
| Ex. 2 | Y ≤ 35 | 9952 |
| Ex. 3 | Y ≤ 35 | 10603 |
| Ex. 4 | Y ≤ 35 | 9968 |
| Ex. 5 | Y ≤ 35 | 8044 |
| Ex. 6 | Y ≤ 35 | 12406 |
| Ex. 7 | Y ≤ 35 | 11372 |
| Comp. 1 | 105 < Y ≤ 140 | 306407 |
| Comp. 2 | 35 < Y ≤ 70 | 25242 |
| Comp. 3 | Y > 350 | >400000 |
| Comp. 4 | Y > 350 | >400000 |
| Comp. 5 | Y > 350 | >400000 |
| Comp. 6 | Y > 350 | 140972 |
| Comp. 7 | 140 < Y ≤ 140 | 296418 |

While the disclosure is susceptible to various modifications and alternative forms, specific embodiments thereof are herein described in detail. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

Note that not all of the activities described in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described herein with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or other features that are inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the embodiments of the disclosure. This description should be read to include one or at least one and the singular also includes the plural, or vice versa, unless it is clear that it is meant otherwise. The term "averaged," when referring to a value, is intended to mean an average, a geometric mean, or a median value. Group numbers corresponding to columns within the Periodic Table of the elements use the "New Notation" convention as seen in the CRC Handbook of Chemistry and Physics, 81st Edition (2000-2001).

Unless otherwise defined, all technical and scientific terms used herein have the same meaning as commonly understood by one of ordinary skill in the art to which this disclosure belongs. The materials, methods, and examples are illustrative only and not intended to be limiting. To the extent not described herein, many details regarding specific materials and processing acts are conventional and may be found in textbooks and other sources within the lubricants as well as the oil and gas industries.

The specification and illustrations are not intended to serve as an exhaustive and comprehensive description of all the elements and features of formulations, compositions, apparatus and systems that use the structures or methods described herein. Separate embodiments may also be provided in combination in a single embodiment, and conversely, various features that are, for brevity, described in the context of a single embodiment, may also be provided separately or in any sub-combination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. A lubricating oil composition for a hybrid engine comprising:

(a) a major amount of an oil of lubricating viscosity;

(b) a borated dispersant in an amount to provide 40 to 400 ppm of boron to lubricating oil composition;

(c) an overbased calcium salicylate or a mixture of an overbased calcium sulfonate and overbased calcium salicylate individually having a total base number of greater than 150 mg KOH/g, measured by the method of ASTM D-2896, present in an amount that provides 950 ppm to 1800 ppm of calcium to the lubricating oil composition;

(d) zinc dithiophosphate (ZnDTP) in an amount to bring from 100 to 800 ppm of phosphorus to the lubricating oil composition; and (e) a non-dispersant comb polymethacrylate (PMA) viscosity index improver (VII), and wherein the KV at 100° C. of the lubricating oil composition is from 6 cSt to 8.5 cSt, the KV at 40° C. of the lubricating oil composition is from 25 cSt to 35 cSt, and the VI of the lubricating oil composition is greater than 200.

2. The lubricating oil composition of claim 1, further comprising:

one or more magnesium-containing detergents in an amount to provide 100 to 600 ppm of magnesium to the lubricating oil composition.

3. The lubricating oil composition of claim 1, wherein the borated dispersant is a borated succinimide dispersant.

4. The lubricating oil composition of claim 1, further comprising a molybdenum-containing compound in an amount to provide 50 to 1000 ppm of molybdenum to the lubricating oil composition.

5. The lubricating oil composition of claim 1, further comprising a friction modifier, ashless anti-wear additive, antioxidant, metal deactivator, seal swell additive, foam inhibitor, or viscosity modifier.

6. The lubricating oil composition of claim 1, wherein the zinc dithiophosphate is zinc dialkyldithiophosphate.

7. The lubricating oil composition of claim 1, wherein the oil of lubricating viscosity is a Group III base oil.

8. The lubricating oil composition of claim 1, wherein the viscosity grade of the lubricating oil is 0W-12, 0W-16, or 0W-20.

9. A method of lubricating a hybrid engine, the method comprising providing the hybrid engine with a lubricating oil comprising:

(a) a major amount of an oil of lubricating viscosity;

(b) a borated dispersant in an amount to provide 40 to 400 ppm of boron to the lubricating oil composition;

(c) an overbased calcium salicylate or a mixture of an overbased calcium sulfonate and overbased calcium salicylate individually having a total base number of greater than 150 mg KOH/g, as measured by the method of ASTM D-2896, present in an amount that provides 900 ppm to 1800 ppm of calcium to the lubricating oil composition;

(d) zinc dithiophosphate (ZnDTP) in an amount to provide 100 to 800 ppm of phosphorus to the lubricating oil composition;

(e) and a non-dispersant comb polymethacrylate (PMA) viscosity index improver (VII), wherein the KV at 100° C. of the lubricating oil is from 6 cSt to 8.5 cSt, the KV at 40° C. of the lubricating oil composition is from 25 cSt to 35 cSt, and the VI of the lubricating oil composition is greater than 200.

10. The method of claim 9, wherein the lubricating oil further comprises:

one or more magnesium-containing detergents in an amount to provide 100 to 600 ppm of magnesium to the lubricating oil composition.

11. The method of claim 9, wherein the borated dispersant is a borated succinimide dispersant.

12. The method of claim 9, wherein the lubricating oil further comprises a molybdenum-containing compound in an amount to provide 50 to 1000 ppm of molybdenum to the lubricating oil composition.

13. The method of claim 9, wherein the lubricating oil further comprises a friction modifier, ashless anti-wear additive, antioxidant, metal deactivator, seal swell additive, foam inhibitor, or viscosity modifier.

14. The method of claim 9, wherein the zinc dithiophosphate is zinc dialkyldithiophosphate.

15. The method of claim 9, wherein the oil of lubricating viscosity is a Group III base oil.

16. The method of claim 9, wherein the lubricating oil has a viscosity grade of 0W-12, 0W-16 or 0W-20.

* * * * *